US005310615A

United States Patent [19]

Tanikawa

[11] Patent Number: 5,310,615

[45] Date of Patent: May 10, 1994

[54] IMAGE FORMING METHOD

[75] Inventor: Hirohide Tanikawa, Yokohama, Japan

[73] Assignee: Canon Kabushiki Kaisha, Tokyo, Japan

[21] Appl. No.: 626,210

[22] Filed: Dec. 12, 1990

[30] Foreign Application Priority Data

Dec. 12, 1989 [JP] Japan ..... 1-320484

[51] Int. Cl.[5] ..... G03G 9/14

[52] U.S. Cl. ..... 430/106.6; 430/109; 430/110; 430/111; 430/126

[58] Field of Search ..... 430/122, 126, 106.6, 430/110, 109, 111

[56] References Cited

U.S. PATENT DOCUMENTS 3,909,258 9/1975 Kotz ..... 96/1
4,870,461 9/1989 Watanabe et al. ..... 355/251
4,978,597 12/1990 Nakuhara et al. ..... 430/122

FOREIGN PATENT DOCUMENTS 0314459 5/1989 European Pat. Off. .
0323252 5/1989 European Pat. Off. .
0331425 9/1989 European Pat. Off. .
0331425 9/1989 European Pat. Off. .... G03G 15/01
0430076 6/1991 European Pat. Off. .
54-43037 4/1979 Japan .
55-18656 2/1980 Japan .
55-18659 2/1980 Japan .
57-38440 3/1982 Japan ..... G03G 9/08
57-66455 4/1982 Japan .

OTHER PUBLICATIONS

Search Report.

*Primary Examiner*—Marion E. McCamish
*Assistant Examiner*—Rosemary Ashton
*Attorney, Agent, or Firm*—Fitzpatrick, Cella, Harper & Scinto

[57] ABSTRACT

An image forming method and an apparatus therefor are provided by using a negatively chargeable magnetic toner which comprises a binder resin and magnetic powder and is in the form of particles providing a volume-average particle size of 4 microns or above and below 7 microns and having a number-bias distribution and a triboelectric chargeability satisfying the relation of:

$$-0.1(\mu c/g)\times A-20(\mu c/g)\leqq Q(\mu c/g)\leqq -0.1(\mu c/g)\times A-2(\mu c/g),$$

wherein A is a real number in the range of 20–35 denoting a coefficient of variation of number-basis distribution of particle sizes of the magnetic toner defined by $S/\overline{D}_1\times 100$ wherein S denotes a standard deviation of number-basis particle size distribution of the magnetic toner and $\overline{D}_1$ denotes a number-average particle size of the magnetic toner, and Q denotes a triboelectric charge ($\mu c/g$) of the magnetic toner with iron powder.

19 Claims, 5 Drawing Sheets

IMAGE FORMING METHOD

FIELD OF THE INVENTION AND RELATED ART

The present invention relates to an image forming method for developing an electrostatic image with a magnetic toner by a process such as electrophotography, electrostatic printing and electrostatic recording, and also an image forming apparatus suitable for accomplishing such a method.

Hitherto, as a developing method using a one-component magnetic toner, one using an electroconductive magnetic toner has been known as disclosed in, e.g., U.S. Pat. No. 3,909,258.

In such a developing method, however, the toner is essentially required to be electroconductive, and it is difficult to transfer a toner image of such an electroconductive toner formed on a latent image-bearing member to a final image-supporting member, such as plain paper.

A novel developing method solving a problem accompanying such a conventional developing method using a one-component magnetic toner has been proposed (e.g., in Japanese Laid-Open Patent Applications JP-A 55-18656 and 55-18659), wherein an insulating magnetic toner is uniformly applied onto a cylindrical toner-carrying member having a magnet inside thereof and is disposed opposite to but free from contact with a latent image-bearing member to effect development. The magnetic toner layer may be formed on the toner-carrying member by using a blade for application at the exit of a toner container. As shown in FIG. 1, for example, a blade 1*a* composed of a magnetic material is disposed opposite to one magnetic pole N1 of a fixed magnet which is installed inside a toner-carrying member 2, ears of the magnetic toner are formed along lines of magnetic force acting between the magnetic pole and the magnetic blade, and the ears are cut by the blade tip edge to regulate the thickness of the magnetic toner layer under the action of a magnetic force (see, e.g., JP-A 54-43037).

At the time of development, a low-frequency alternating voltage is applied between the toner-carrying member and the substrate of the latent image-bearing member to cause a reciprocal movement of the magnetic toner between the toner-carrying member and the latent image-bearing member, whereby good development is performed. As the magnetic toner used in this developing method is insulating, electrostatic transfer may be performed.

An image forming apparatus shown in FIG. 2 is equipped with a developer container 7 enclosing a toner 10, and a latent image-bearing member 9, such as a photosensitive drum for electrophotography or an insulating drum for electrostatic recording (hereinafter representatively called "photosensitive member" or "photosensitive drum").

In such a developing method, it is important to satisfy the following two requirements i.e., (A) to coat a toner-carrying member with a uniform layer of a magnetic toner, and (B) to prevent or minimize the staining or soiling of the toner-carrying member surface with components of the magnetic toner. However, these requirements (A) and (B) are rather contradictory, and it is generally difficult to satisfy the requirements simultaneously.

As for the requirement (A) of uniformly coating a toner-carrying member with a magnetic toner, a method of forming a uniform toner coating layer of a magnetic toner on a toner-carrying member is also proposed by JP-A 57- 66455, and a uniform toner layer may be stably formed thereby for a long term. In the developing apparatus for effecting the method, the surface of a toner-carrying member is provided with an indefinite unevenness pattern as shown in FIG. 10 by sand-blasting the surface with irregular-shaped particles, so as to always provide a uniform toner coating state for a long period of time. The entire surface of the toner-carrying member thus treated has minute cuttings or projections disposed at random.

A developing apparatus using a toner-carrying member having such a specific surface state can result in attachment of the toner or some component therein onto the surface depending on the magnetic toner used. Thus, the toner-carrying member surface is liable to be soiled and result in a decrease in image density at the initial stage and white image dropout is caused for each revolution cycle of the toner-carrying member as the staining is promoted during a successive copying operation. These difficulties are caused by insufficient charge of magnetic toner particles and shortage of charge of the magnetic toner layer due to attachment of toner components onto side slopes of convexities and concavities on the toner-carrying member surface.

A magnetic toner generally comprises components, such as a binder resin, a magnetic material, a charge control agent, and a release agent. These materials may be selected so as to prevent the soiling of the toner-carrying member surface, whereby the selection of materials is restricted thereby.

As for the requirement (B) of preventing or minimizing the soiling of the magnetic toner-carrying member, it is clearly suitable that the toner-carrying member surface is smoothened. In such a method, however, it has been experimentally observed that the toner coating is liable to be ununiform to cause irregularities in toner images, thus failing to provide good toner images, in case where the magnetic toner has a volume-average particle size of 12 microns or larger. When the occurrence of such a toner coating irregularity was carefully observed based on blank operation of a developing apparatus, the following phenomena were observed.

In the case where the toner-carrying member surface was smooth, while the cause thereof was unclear, the toner coating layer became excessively thick at the initial stage of the blank operation and, when the toner thickness was regulated by a blade 1*a*, the gradually swelled out (at a part A in FIG. 2A) to form a stagnant toner knob 10*a* (as shown in FIG. 3 as an enlarged view). When the toner knob reached a certain size, it was transferred to the sleeve surface outside the toner vessel 7 owing to the conveying force of the sleeve 2 to cause coating irregularities or clogs 3*a*. When such toner clogs 3*a* appeared on the toner coating layer 3, they led to irregularities on the images, which were observed as density irregularities or fog. The toner coating irregularities appeared in various shapes, such as rectangular spots, waveform spots and waveform patterns.

As described above, in the conventional developing methods, it has been extremely difficult to satisfy the requirements (A) and (B) in combination. The above difficulties become pronounced under low-humidity condition and/or in a developing apparatus wherein the toner-carrying member rotates at a high peripheral speed.

In order to improve the image quality, there have been proposed a magnetic toner having a volume-average particle size and a specific particle size distribution, and also an image-forming apparatus using the magnetic toner in European Laid-Open Patent Specification EP-A 0314459.

Further, EP-A 0331425 has proposed an image forming method wherein a magnetic toner having a volume-average particle size of 4–9 microns and a specific particle size distribution is supplied to a toner-carrying member having a surface with an unevenness comprising sphere-traced concavities, so as to develop an electrostatic latent image.

However, a further improved image forming method and an apparatus therefor suitably applicable to a higher developing speed are still being desired.

SUMMARY OF THE INVENTION

A generic object of the present invention is to provide an image forming method and an image forming apparatus having solved the above-mentioned problems.

A more specific object of the invention is to provide an image forming method and an image forming apparatus capable of providing good toner images even at a high developing speed.

An object of the invention is to provide an image forming method and an image forming apparatus excellent in environmental stability (stability against changes in environmental conditions).

An object of the invention is to provide an image forming method and an image forming apparatus excellent in durability against continuous image formation for a large number of sheets.

An object of the invention is to provide an image forming method and an image forming apparatus capable of providing toner images with good resolution and gradation characteristic.

A further object of the present invention is to provide an image forming method and an image forming apparatus capable of providing clear high-quality images which have a high-image density, and excellent thin-line reproducibility and gradation characteristic and are free from fog for a long term.

According to a principal aspect of the present invention, there is provided an image forming method, comprising:

disposing a latent image-bearing member and a toner-carrying member with a prescribed gap therebetween;

supplying a magnetic toner onto the toner-carrying member, wherein the magnetic toner comprises a binder resin and magnetic powder and is in the form of particles providing a volume-average particle size of 4 microns or above and below 7 microns and having a number-bias distribution and a triboelectric chargeability satisfying the relation of:

$$-0.1(\mu c/g)\times A-20(\mu c/g)\leqq Q(\mu c/g)\leqq -0.1(\mu c/g)\times A-2(\mu c/g),$$

wherein A is a real number in the range of 20–35 denoting a coefficient of variation of number-basis distribution of particle sizes of the magnetic toner defined by $S/\overline{D}_1\times 100$ wherein S denotes a standard deviation of number-basis particle size distribution of the magnetic toner and $\overline{D}_1$ denotes a number-average particle size of the magnetic toner, and Q denotes a triboelectric charge ($\mu c/g$) of the magnetic toner when subjected to triboelectrification by mixing with iron powder;

triboelectrically charging the magnetic toner to provide the magnetic toner with a negative charge;

forming an electrostatic latent image on the latent image-bearing member;

developing the electrostatic latent image with the magnetic toner having a negative triboelectric charge to form a toner image; and transferring the toner image on the latent image-bearing member to a transfer-receiving material.

According to another aspect of the present invention, there is provided an image forming apparatus, comprising: a latent image-bearing member, developing means for developing an electrostatic latent image to form a toner image on the latent image-bearing member including a toner-carrying member and a toner container, and transfer means for transferring the toner image on the latent image-bearing member to a transfer-receiving member, wherein the latent image-bearing member and the toner-carrying member are disposed with a prescribed gap therebetween, and the toner container contains therein a magnetic toner to be supplied onto the toner-carrying member;

wherein the magnetic toner is the same as defined above.

These and other objects, features and advantages of the present invention will become more apparent upon a consideration of the following description of the preferred embodiments of the present invention taken in conjunction with the accompanying drawings.

DETAILED DESCRIPTION OF THE INVENTION

A toner-carrying member having a smooth surface or a specific uneven surface provided with sphere-traced concavities can be free from soiling or accompanied with minimum soiling for a long term because magnetic toner components are not readily attached to the surface, so that the toner-carrying member is free from decrease in its charge-imparting ability and can effectively and stably charge a magnetic toner for a long term. However, such a toner-carrying member is somewhat inferior with respect to uniform application of a magnetic toner thereto under certain conditions in comparison with a toner-carrying member having an uneven surface provided with an enormous number of minute cuttings or projections formed by blasting with indefinite-shaped particles. For example, in case where a magnetic toner having a large chargeability is used in a high-speed machine under a low-humidity condition, as the toner-carrying member has a large charge-imparting ability, the magnetic toner is provided with a large charge, so that the image force onto the toner-carrying member is increased and the agglomerating force of the magnetic toner is enhanced to form agglomerates of the magnetic toner, thus causing toner coating irregularities.

If a magnetic toner having a volume-average particle size of 4 microns or above and below 7 microns and having a specific particle size distribution as well as an appropriate chargeability is used according to the present invention, the magnetic toner is prevented from forming an excessively thick toner coating layer even on various-types of toner-carrying members so that a uniform magnetic toner coating layer can be formed without causing toner coating irregularities for a long term. As a result, it is possible to obtain clear high-quality images which have high image density, excellent thin line reproducibility and are free from fog for a long period.

Figure 9:
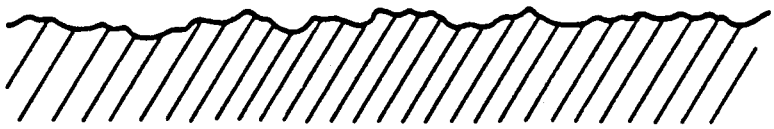
FIG 9 is a partial sectional view illustrating a characteristic surface state of a sleeve blasted with spherical definite-shaped particles.
Figure 10:
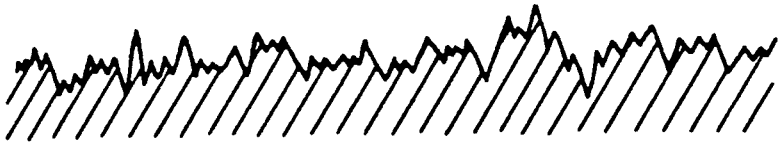
FIG. 10 is a partial sectional view illustrating a characteristic surface state of a sleeve blasted with indefinite-shaped particles.

While the present invention is applicable to various types of toner-carrying members (hereinafter called "(developing) sleeve") as described above, it is preferred to use a sleeve having a surface unevenness comprising sphere-traced concavities. The surface state can be obtained by blasting with definite shaped particles. The definite-shaped particles may for example be various solid spheres or globules, such as those of metals such as stainless steel, aluminum, steel, nickel and bronze, or those of ceramic, plastic or glass beads, respectively, having a specific particle size. By blasting the sleeve surface with such definite-shaped particles having a specific particle size, it is possible to form a plurality of sphere-shaped concavities with sizes in a specific range as shown in FIG. 9.

In the present invention, the plurality of sphere-traced concavities on the sleeve surface may preferably be formed by blasting with spheres having a diameter R of 20 to 250 microns. If the diameter R is smaller than 20 microns, the soiling with a magnetic toner component is increased. On the other hand, a diameter R of over 250 microns is not preferred because the uniformity of toner coating on the sleeve is liable to be lowered. As a result, the sleeve surface may be provided with concavities having a diameter of 250 microns or smaller, preferably in the range of 20–250 microns.

In the present invention, the pitch P and the surface roughness d of the unevenness on a sleeve surface are based on measured values of roughness of the sleeve obtained by using a micro-surface roughness meter (commercially available from, e.g., Taylor-Hopson Co., and Kosaka Kenkyusho K.K.), and the surface roughness d is expressed in terms of a 10 point-average roughness (Rz) (JIS B 0601).

Figure 4:
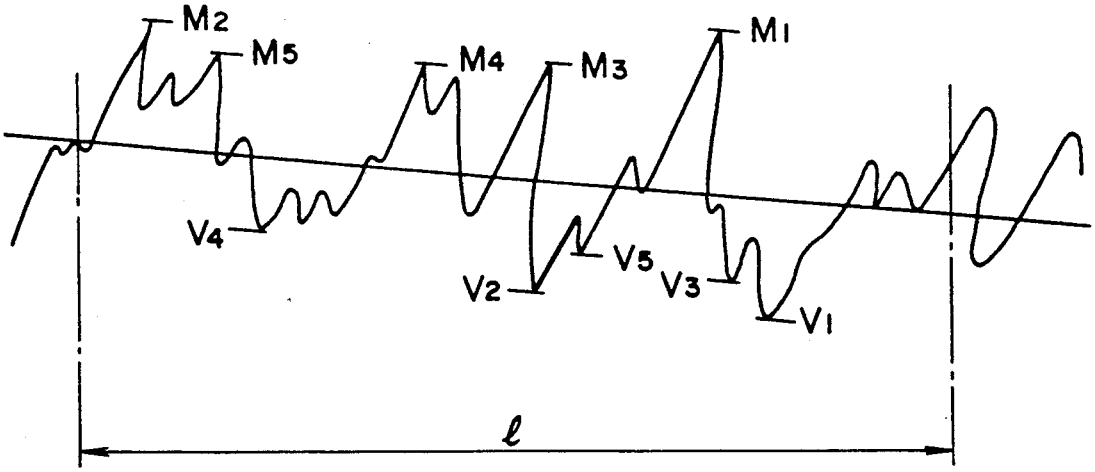
FIG. 4 is an illustration for defining surface roughness and pitch.

More specifically, FIG. 4 shows an example of a surface section curve, from which a portion with a standard length l is taken. In the portion, an average line is drawn as shown in FIG. 4, and then two lines each parallel with the average line are taken, one passing through a third highest peak ($M_3$) and the other passing through a third deepest valley or bottom ($V_3$). The 10 point-average roughness ($R_z$ or d) is measured as the distance between the two lines in the unit of microns (micro-meters), and the standard length l is taken as 0.25 mm. The pitch P is obtained by counting the number of peaks having a height of 0.1 micron or higher with respect to the bottoms on both sides thereof and defined as follows: P=250 (microns)/(the number (n) of the peaks in the length of 250 (microns)).

In the present invention, the pitch P of the roughness on the sleeve surface may preferably be 2 to 100 microns. A pitch P of less than 2 microns is not preferred because the soiling of the sleeve with toner component is increased. On the other hand, a pitch P in excess of 100 microns is not preferred because the uniformity of toner coating on the sleeve is lowered. The surface roughness d of the roughness on the sleeve surface may preferably be 0.1 to 5 microns. A roughness d in excess of 5 microns is not preferred because an electric field is liable to be concentrated at uneven portions to cause disturbance in images in a system wherein an alternating voltage is applied between the sleeve and the latent image-holding member to cause jumping of the magnetic toner from the sleeve side onto the latent image surface. On the other hand, a roughness d of less than 0.1 micron is not preferred because the uniformity of toner coating on the sleeve is lowered.

The blasting with definite-shaped particles may be additionally applied to a sleeve surface which has been blasted with indefinite shaped particles.

It is preferred that the definite-shaped blasting particles are larger than the indefinite-shaped blasting particles, preferably with the former being 1–20 times, particularly 1.5–9 times, the latter.

In the latter blasting with definite-shaped particles, it is preferred to set at least one of the blasting time and the impinging force with the particles to be smaller than that with the indefinite-shaped particles.

It is also possible to blast a sleeve surface simultaneously with indefinite-shaped particles and definite-shaped particles. As the indefinite-shaped particles, any abrasive particles may be used. In this case, the resultant pitch and roughness are different from those obtained by the definite-shaped particles.

It is a characteristic feature of the negatively chargeable magnetic toner according to the invention that it has a volume-average particle size of 4 microns or larger and smaller than 7 microns, preferably of 4 to 6.6 microns, and a coefficient of variation (or variation coefficient) A of number-basis particle size distribution in the range of 20–35 preferably 21–34.

Herein, the variation coefficient is a statistic value showing a degree of variation or fluctuation from the average value. A magnetic toner having a desired particle size distribution and a desired variation coefficient thereof can be obtained by effecting strict classification by under controlled classification conditions. A smaller variation coefficient means a narrower particle size distribution and a larger variation coefficient means a broader particle size distribution. However, a variation coefficient is a measure of variation of particle size depending on the number-average particle size of a magnetic toner. Accordingly, a desired variation coefficient cannot simply be obtained by removal of fine powder fraction and coarse powder fraction by classification. A magnetic toner suitable for the present invention can be obtained for the first time by measuring the particle size distribution of a finely pulverized product (feed material for classification) to know the mode particle size, the content of super fine to fine powder fraction, the content of fraction near the mode particle size, and the content of coarse powder fraction, and carefully classifying the pulverized product while adjusting the classifying conditions (such as setting of edge gap and differential pressure, e.g., for Elbow Jet Classifier, available from Nittetsu Kogyo K.K.) based on the above factors.

Figure 3:
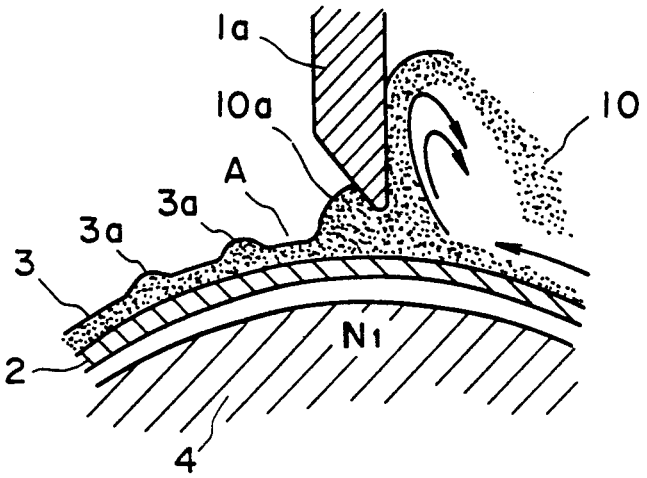
FIG. 3 is an illustration as to how toner coating irregularities are caused.

As described above, it is preferred to use such a negatively chargeable magnetic toner in combination with a sleeve having a specific uneven surface with sphere-traced concavities formed by blasting with spherical definite shaped particles (hereinafter called "instant sleeve 2-1"). Such an instant sleeve 2-1 showed a somewhat inferior performance in forming a uniform magnetic toner coating layer thereon compared with a sleeve having an uneven surface formed by blasting with indefinite-shaped particles (hereinafter called "comparative sleeve 2-2") under certain conditions. More specifically, when a negatively chargeable magnetic toner having a volume-average particle size exceeding 12 microns was charged in two developing apparatus having the instant sleeve 2-1 and the comparative sleeve 2-2, respectively, in a specific environment of temperature of below 15° C. and humidity of below 10%, and subjected to blank rotation, whereby the respective apparatus provided a toner coating layer weight per unit area M/S (g/cm$^2$) of 1.6–2.5 mg/cm$^2$ for the instant sleeve 2-1 and 0.6–2.0 mg/cm$^2$ for the comparative sleeve 2-2. Thus, the instant sleeve provided a larger thickness of toner coating layer and was found to cause a toner coating irregularity as shown in FIG. 3 on further continuation of blank rotation for a longer period.

As a result of further investigation of ours, however, while the reason has not been clarified as yet, when similar experiments were performed by using a negatively chargeable magnetic toner having particle size distribution stipulated by the present invention, even the instant sleeve 2-1 was found to provide a suppressed coating thickness at M/S of 0.7–1.5 mg/cm$^2$. Further, even on continuation of blank rotation for a long period, coating irregularity did not occur, so that the decrease in toner coating thickness was found to be very effective in uniformization of toner coating for a long term.

However, it was found that even a negatively chargeable magnetic toner having a volume-average particle size in the range of 4 microns or above and below 7 microns and a variation coefficient of number-basis particle size distribution (hereinafter sometimes simply referred to as "variation coefficient) in the range of 20–35 could form agglomerates thereof leading to toner coating irregularity when the sleeve was rotated at a high peripheral speed of 220 mm/sec or higher and the blank rotation was continued for a long time under a low humidity condition. It was also found that a higher sleeve peripheral speed resulted in a shorter time until the occurrence of toner agglomerates. The triboelectric charge of the magnetic toner before the occurrence of the sleeve coating irregularity increased with the progress of the blank rotation time to reach a value which was considerably larger than that of a magnetic toner free from occurrence of sleeve coating irregularity. When these magnetic toners were subjected to measurement of triboelectric charges by mixing with iron powder, the former toner showed a larger value than the latter.

When a magnetic toner having an increasing triboelectric charge is applied to a high-speed machine, it was found to cause sleeve coating irregularity under a low humidity condition for the same reason as described above.

There was observed a tendency that a magnetic toner having a variation coefficient of below 20 with the volume-average particle size range of 4 microns or larger to below 7 microns showed an increasing M/S value on the sleeve to cause sleeve coating irregularity while the reason has not been clarified yet. On the other hand, a magnetic toner having a variation coefficient exceeding 45 has a wide particle size distribution, so that the magnetic toner particles are caused to have uniform charges and tend to cause a decrease in image density and disorder of ears formed on the sleeve leading to roughening of images and decrease in resolution.

The variation coefficient A of number-basis particle size distribution of a magnetic toner may be adjusted by the classification step. Within the variation coefficient range of 20–35, the magnetic toner can be uniformly applied onto a sleeve to provide good toner images, if the triboelectric charge Q of the magnetic toner. When subjected to triboelectrification with iron powder satisfies the relationship of: $-0.1A-1 \geqq Q \geqq -0.1A-20$, (preferably $-0.1A-3 \geqq Q \geqq -0.1A-19$, further preferably $-0.1A-4 \geqq Q \geqq -0.1A-18$).

In case of $Q < -0.1A-20$ (a larger chargeability of the magnetic toner), the magnetic toner is liable to be excessively charged at a high-speed rotation of sleeve (peripheral speed of 220 mmsec or higher) in a low-humidity environment to cause sleeve coating irregularity.

On the other hand, in case of $Q > -0.1A-2$ (a smaller chargeability of the magnetic toner), the toner is not provided with a sufficient developing ability only to result in poor images having a low density. The triboelectric chargeability of the magnetic toner can be controlled by selection of a charge control agent and/or a magnetic material and the amount thereof.

The triboelectric charge R of the magnetic toner on a sleeve may preferably be controlled in a developing apparatus used so as to be −5 to −25 μc/g, further preferably −6 to −24 μc/g, and may preferably differ by 0 to 15 μc/g, preferably 0 to 10 μc/g, in terms of absolute value from the triboelectric charge Q measured by triboelectrification with iron powder. In terms of absolute value, R is generally smaller than Q but can be larger than Q in some cases.

A magnetic toner satisfying the particle size distribution and the chargeability specified according to the present invention is free from disorder of ear formation state and is formed in a thin, short and uniform state so that it can provide clear toner images excellent in thin-line reproducibility and resolution and free from fog.

Further, the magnetic toner according to the present invention is uniform with respect to transferability to and coverage on a transfer-receiving material, so that it is excellent in reproduction of gradation images and can provide a high image density while suppressing the toner consumption.

In production of a magnetic toner, if the pulverization is performed by using a mechanical pulverizer including members such as pin, disk, rotor and liner or an under mild pulverization condition using a jet mill at a low air pressure, a magnetic toner having a large chargeability tends to be produced. In such a case, the magnetic toner coating on a sleeve is liable to be ununiform. Accordingly, it is significant to produce a magnetic toner through pulverization with a jet mill at an appropriate lever of air pressure (4–7 kg/cm$^2$). As a developing sleeve having a smooth surface as described above has an excellent charge-imparting ability, the magnetic toner can be effectively charged triboelectrically. Further, as the charge of the magnetic toner on the sleeve is stabilized, a high density and a high image quality can be always maintained.

Figure 5:
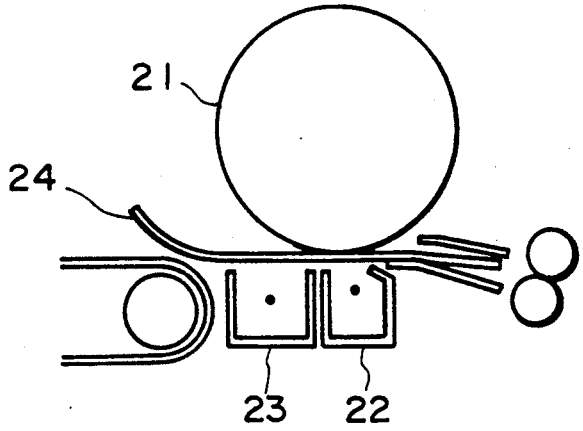
FIG. 5 is a schematic illustration of a transfer device and a separation device.

An electrostatic latent image is developed with such a magnetic toner to form a toner image on a latent image-bearing member 21 as shown in FIG. 5, which is then transferred onto a transfer-receiving material 24 disposed in contact with the toner image while providing the backside of the transfer-receiving material with a charge of a polarity opposite to that of the toner image to cause an electrostatic attraction force by means of a transfer device 22 as shown in FIG. 5.

In an image forming method wherein the charge of a transfer-receiving material 24 is removed by applying AC corona onto the backside of the material 24 by a separating device 23 immediately after the transfer step, a reduction in magnetic toner particle size enhances the contact between the latent image-bearing member 21 and the transfer-receiving material 24, so that it has been disadvantageous in the separation step.

Further, if the magnetic toner has a small charge, the contact thereof onto the transfer-receiving material becomes poor, so that a transfer failure of the magnetic toner onto the transfer-receiving material can be caused at the time of the separation, thus resulting in white dropout of images. On the other hand, if the magnetic toner has a large charge, a transfer irregularity onto the transfer-receiving material is liable to be caused and a back transfer of the magnetic toner onto the latent image-bearing member 21 can be caused at the time of separation of the transfer-receiving material from the latent image-bearing member 21.

In the present invention, the magnetic toner is appropriately controlled in the developing step, so that it is effectively applied to the above-mentioned image forming method without causing a transfer failure.

The particle size distribution of the magnetic toner used herein is based on data measured by means of a Coulter counter, while it may be measured in various manners.

Coulter counter Model TA-II (available from Coulter Electronics Inc.) is used as an instrument for measurement, to which an interface (available from Nikkaki K.K.) for providing a number-basis distribution and a volume-basis distribution, and a personal computer CX-1 (available from Canon K.K.), are connected.

For measurement, a 1%-NaCl aqueous solution as an electrolytic solution is prepared by using a reagent-grade sodium chloride. For example, ISOTON ®-II (available from Coulter Scientific Japan K.K.) may be used therefor. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. Form the results of the volume-basis distribution and number-basis distribution, parameters characterizing the magnetic toner of the present invention may be obtained.

The binder resin for constituting the magnetic toner according to the present invention, when applied to a hot pressure roller fixing apparatus using an oil applicator, may be a known binder resin for toners. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrenevinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrileindene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumarone-indene resin and petroleum resin.

In a hot pressure roller fixing system using substantially no oil application, serious problems are caused by an offset phenomenon that a part of toner image on a toner image-supporting member, such as plain paper, is transferred to a roller, and also in respect of an intimate adhesion of a toner on the toner image-supporting member. As a toner fixable with little heat energy is generally liable to cause blocking or caking in storage or in a developing apparatus, this should be also taken into consideration. With these phenomena, the physical property of a binder resin in a toner is most concerned. According to our study, when the content of a magnetic material in a toner is decreased, the adhesion of the toner onto the toner image-supporting member mentioned above is improved, while the offset is more readily caused and also the blocking or caking are also more liable. Accordingly, when a hot roller fixing system using almost no oil application is adopted in the present invention, selection of a binder resin becomes more serious. A preferred binder resin may for example be a crosslinked styrene copolymer, or a crosslinked polyester.

Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol diacrylate; divinyl compounds such as divinyl ether, divinyl sulfide and divinyl sulfone; and compounds having three or more vinyl groups. These compounds may be used singly or in mixture.

For a pressure-fixing system, a known binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyesters and paraffins.

In the magnetic toner of the present invention, it is preferred that a charge control agent may be incorporated in the toner particles (internal addition), or may be mixed with the toner particles (external addition). By using the charge control agent, it is possible to most suitably control the charge amount corresponding to a developing system to be used. Particularly, in the present invention, it is possible to further stabilize the balance between the particle size distribution and the triboelectric charge.

The negative charge control agent used in the present invention may be selected from known ones, such as carboxylic acid derivatives and their salts, alkoxylates, organic metal complexes and chelate compounds. These compounds may be used alone or in combination of two or more species. Among these, it is particularly preferred to use one or more of acetylacetone metal complexes, salicylic acid metal complexes, alkyl-substituted salicylic acid metal complexes, naphthoic acid metal complexes, and monoazo metal complexes.

It is preferred that the above-mentioned charge control agent is used in the form of fine powder. In such a case, the number-average particle size thereof may preferably be 4 microns or smaller, more preferably 3 microns or smaller.

In the case of internal addition, such a charge control agent may preferably be used in an amount of 0.1–20 wt. parts, more preferably 0.2–10 wt. parts, per 100 wt. parts of a binder resin.

Various additives may be mixed internally or externally in the magnetic toner of the present invention as desired. More specifically, as a colorant, known dyes or pigments may be used generally in an amount of 0.5–20 wt. parts per 100 wt. parts of a binder resin. Another optional additive may be added to the toner so that the toner will exhibit further better performances. Optional additives to be used include, for example, lubricants such as zinc stearate; abrasives such as cerium oxide and silicon carbide; flowability improvers such as colloidal silica and aluminum oxide; anti-caking agent; or conductivity-imparting agents such as carbon black and tin oxide.

In order to improve releasability in hot-roller fixing, it is also a preferred embodiment of the present invention to add to the magnetic toner a waxy material such as low-molecular weight polyethylene, low-molecular weight polypropylene, microcrystalline wax, carnauba wax, sasol wax or paraffin wax preferably in an amount of 0.5–5 wt. % based on the binder resin.

The magnetic toner of the present invention contains a magnetic material which can also function as a colorant. The magnetic material to be contained in the magnetic toner may be one or a mixture of: iron oxides such as magnetite, hematite, ferrite and ferrite containing excess iron; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These ferromagnetic materials may preferable be in the form of particles having an average particle size of the order of 0.1–1 micron, preferably 0.1–0.5 microns and be used in the toner in an amount of about 50–150 wt. parts, particularly 60–120 wt. parts, per 100 wt. parts of the resin component.

The magnetic toner for developing electrostatic images according to the present invention may be produced by sufficiently mixing magnetic powder with a vinyl or non-vinyl thermoplastic resin such as those enumerated hereinbefore, and optionally, a pigment or dye as colorant, a charge controller, another additive, etc., by means of a mixer such as a ball mill, etc.; then melting and kneading the mixture by hot kneading means such as hot rollers, kneader and extruder to disperse or dissolve the pigment or dye, and optional additives, if any, in the melted resin; cooling and crushing the mixture; and subjecting the powder product to precise classification to form the magnetic toner according to the present invention.

It is possible that silica fine powder is added internally or externally to the magnetic toner of the present invention. The external addition is preferred.

The magnetic toner which is a characteristic of the present invention can be inferior in respect of fluidity in some cases, so that it can fail to sufficiently exhibit its triboelectric chargeability depending on a developing apparatus used.

By externally adding silica fine powder to the magnetic toner according to the invention, the fluidity thereof can be improved to increase the opportunity of friction with the triboelectric charging member such as the sleeve and have the magnetic toner exhibit its triboelectric chargeability more effectively, so that the magnetic toner can exhibit good developing characteristic in various types of developing apparatus.

In the magnetic toner of the present invention having the above-mentioned particle size distribution characteristic, the specific surface area thereof becomes larger than that in the conventional toner. In a case where the magnetic toner particles are caused to contact the surface of a cylindrical electroconductive sleeve containing a magnetic field-generating means therein in order to triboelectrically charge them, the frequency of the contact between the toner particle surface and the sleeve is increased as compared that in the conventional magnetic toner, whereby the abrasion of the toner particle or the contamination of the sleeve is liable to occur. However, when the magnetic toner of the present invention is combined with the silica fine powder, the silica fine powder is disposed between the toner particles and the sleeve surface, whereby the abrasion of the toner particle is remarkably reduced. Thus, the life of the magnetic toner and the sleeve may be elongated and the chargeability may stably be retained. As a result, there can be provided a magnetic toner showing excellent characteristics in long-time use.

The silica fine powder may be those produced through the dry process or the wet process. A silica fine powder produced through the dry process is preferred in view of the anti-filming characteristic and durability thereof.

The dry process referred to herein is a process for producing silica fine powder through vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

On the other hand, in order to produce silica fine powder to be used in the present invention through the wet process, various processes known heretofore may be applied. For example, decomposition of sodium silicate with an acid represented by the following scheme may be applied:

$$Na_2O.xSiO_2+HCl+H_2O \rightarrow SiO_2.nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica powder to be used herein may be anhydrous silicon dioxide (colloidal silica), and also a silicate such as aluminum silicate, sodium silicate, potassium silicate, magnesium silicate and zinc silicate.

Among the above-mentioned silica powders, those having a specific surface area as measured by the BET method with nitrogen adsorption of 30 $m^2/g$ or more, particularly 50–400 $m^2/g$, provide a good result.

In the present invention, the silica fine powder may preferably be used in an amount of 0.01–8 wt. parts, more preferably 0.1–5 wt. parts, with respect to 100 wt. parts of the magnetic toner.

The silica fine powder used in the present invention may be surface-treated as desired so as to be provided with hydrophobicity or stability of chargeability. Such treating agents may for example be silane coupling agent, silicone varnish, silicone oil or organic silicon compound. These can have a functional group. The silica fine powder may be treated with such agents which are reactive with or physically adsorbed by the silica fine powder. Examples of such treating agents may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, aminopropyltrimethoxysilane, aminopropyltriethoxysilane, dimethylaminopropyltrimethoxysilane, diethylaminopropyltrimethoxysilane, dipropylaminopropyltrtimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzyl-amine. Further, examples of the nitrogen-containing heterocyclic compounds represented by the above structural formulas include: trimethoxysilyl-γ-propylpiperidine, trimethoxysilyl-γ-propylmorpholine, trimethoxysilyl-γ-propylimidazole, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

Silicone oils yet-unmodified state may be represented by the following formula:

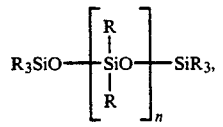

wherein R denotes an alkyl and n is an integer.

Preferred silicone oils or modified product thereof are those having a viscosity of about 5–5000 centiStokes at 25° C. Examples thereof may include: methylsilicone oil, dimethyl-silicone oil, phenylmethyl-silicone oil, chlorophenylmethyl-silicone oil, alkyl-modified silicone oil, aliphatic acid-modified silicone oil, amino-modified silicone oil, and polyoxyalkyl-modified silicone oil. These may be used alone or in mixture of two or more species.

The above treatments may be used singly or in combination.

The thus treated silica fine powder may be effectively added in an amount of 0.01–8 wt. parts, particularly preferably 0.1–5 wt. parts for providing excellent stable negative chargeability, to 100 wt. parts of the negatively chargeable magnetic toner. In a particularly preferred addition state, 0.1–3 wt. parts of the treated silica fine powder may be added in a state of being attached to the toner particle surface. The yet-untreated silica fine powder described hereinbefore may be added in a similar amount.

To the negatively chargeable magnetic toner according to the present invention, it is also possible to internally or externally add fine powder of metal oxide, fine powder of fluorine-containing polymer or fine powder of another resin. Examples of the fluorine-containing polymer may include polytetrafluoroethylene, polyvinylidene fluoride, or tetrafluoroethylene-vinylidene fluoride copolymer. Among these, polyvinylidene fluoride fine powder is particularly preferred in view of fluidity and abrasiveness. Such fine powder may preferably be added to the toner in an amount of 0.01–2.0 wt. %, particularly 0.02–1.0 wt. %.

The metal oxide fine powder may for example be fine powder of cerium oxide, strontium titanate, barium titanate, titania or alumina, which may preferably be added in a proportion of 0.01–10 wt. %, particularly 0.1–7 wt. %, of the toner.

In a magnetic toner wherein the silica fine powder and the above-mentioned fine powder are combined, while the reason is not necessarily clear, there occurs a phenomenon such that the state of the presence of the silica attached to the toner particle is stabilized and, for example, the attached silica is prevented from separating from the toner particle so that the effect thereof on toner abrasion and sleeve contamination is prevented from decreasing, and the stability in chargeability can further be enhanced.

Figure 1:
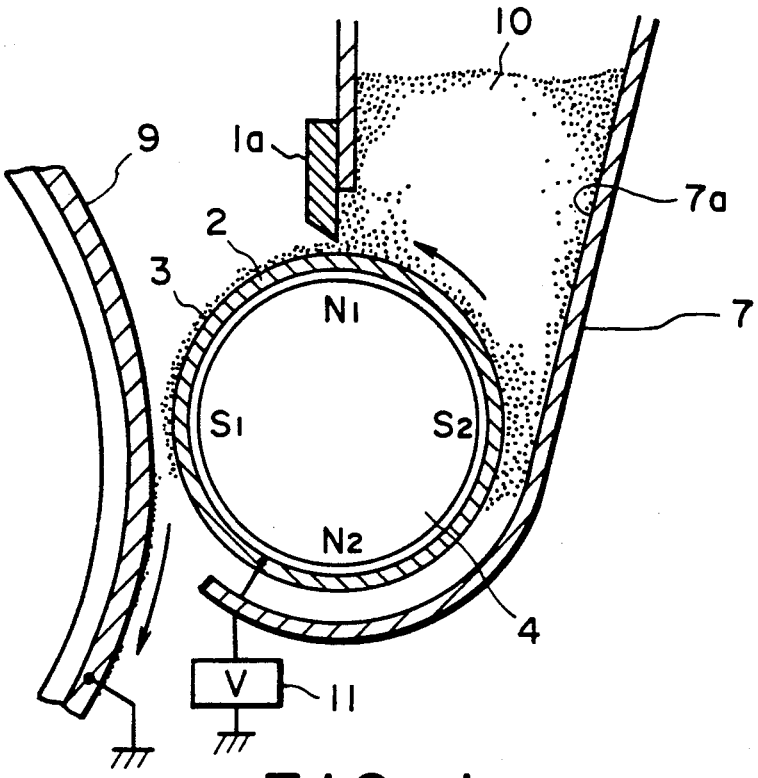
FIG. 1 is a schematic illustration of a developing apparatus according to the present invention.
Figure 2:
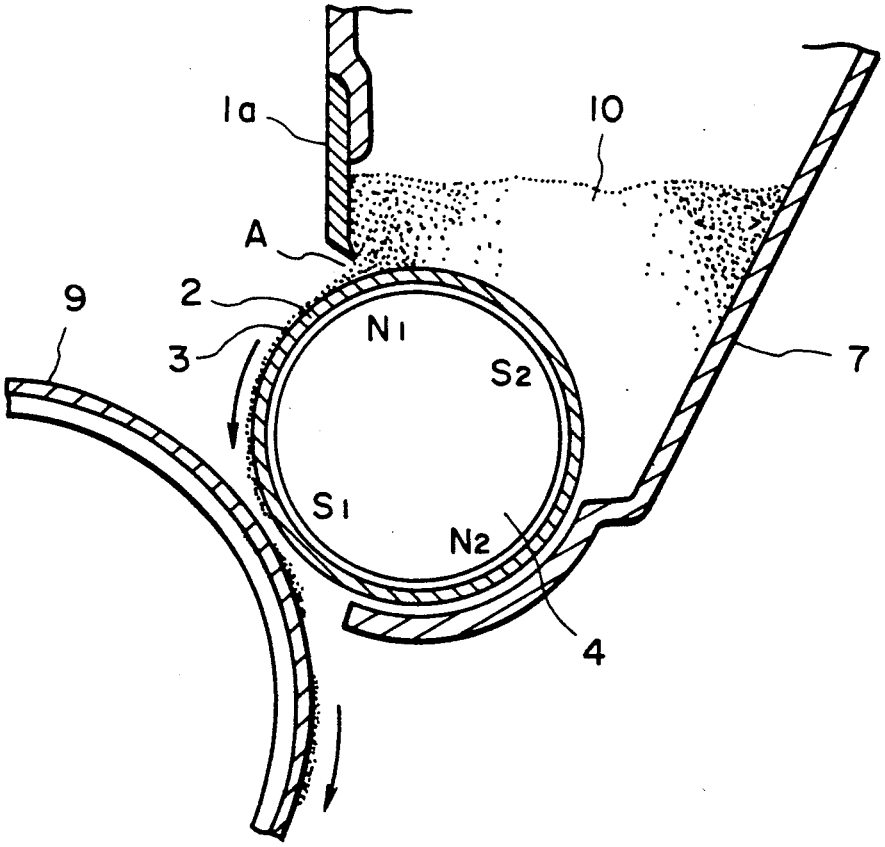
FIG. 2 is a sectional view of a developing apparatus using a magnetic blade.

FIG. 1 shows an example of a specific apparatus for practicing the developing step of the present invention.

Referring to FIG. 1, a developing apparatus 7 has a wall *7a* in which a magnetic toner 10 is contained and, a non-magnetic sleeve 2, which may be one of stainless steel (SUS 304) having a diameter of 50 mm and having an uneven surface comprising a plurality of sphere-traced concavities. The sleeve contains inside therein a magnet 4 having magnetic poles $N_1=850$ Gauss, $N_2=500$ Gauss, $S_1=650$ Gauss and $S_2=500$ Gauss. A blade 1*a* as a toner layer thickness regulating means may be composed of iron which is a magnetic material. Between the blade 1*a* and the sleeve 2, a gap of 250 microns is formed, and a toner layer 3 of the toner 10 of the present invention is formed in a layer thickness of about 180 microns. A bias electric supply 11 as a biasing means provides an AC of Vpp=1200 V and a frequency f=800 Hz superposed with a DC=+100 V. A latent image-bearing member 9 is disposed with a minimum distance of 300 microns from the sleeve 2.

Figure 8:
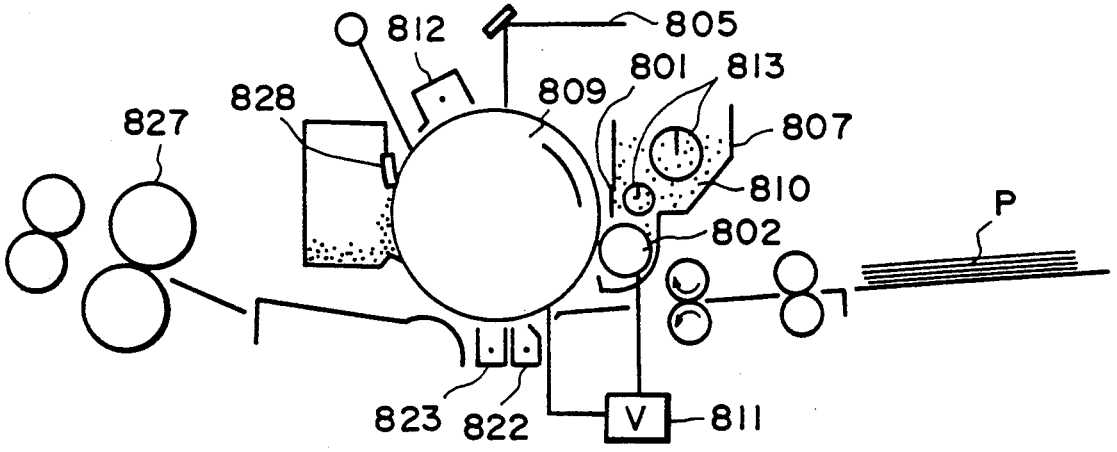
FIG. 8 is a schematic sectional illustration of an embodiment of the image forming apparatus according to the present invention.

A further embodiment of the image forming method and the image forming apparatus according to the present invention will be specifically explained with reference to FIG. 8.

The surface of a photosensitive drum 809, such as amorphous silicone drum is charged, e.g., in a positive polarity by a primary charger 812, then exposed with image light 805 to form a electrostatic latent image, and the latent image is developed with a mono-component-type magnetic developer 810 comprising a magnetic toner contained in a developing device 807 equipped with a magnetic blade 801, a developing sleeve 802 containing therein a magnet and a toner stirring means 813. At the developing station or zone, an alternating bias, a pulsed bias and/or a DC bias is applied between the electroconductive substrate of the photosensitive drum 809 and the developing sleeve 802 by a bias application means 811. A sheet of transfer paper P is conveyed to reach a transfer station, where the back side (opposite side with respect to the photosensitive drum) of the transfer paper is charged by a transfer means 822, whereby a developed image (toner image) on the photosensitive drum surface is electrostatically transferred. The transfer paper P separated from the photosensitive drum 809 by means of an electrostatic separation means 823 is sent to a hot pressure roller fixer where the toner image on the transfer paper P is fixed.

Some magnetic toner remaining on the photosensitive drum 809 after the transfer step is removed by a cleaning device 828 equipped with a cleaning blade. The photosensitive drum 809 is discharged by an erasing exposure light source 826 and is subjected to a repeating cycle starting with the charging step by the primary charger 832.

The photosensitive drum (electrostatic image-bearing member) comprises a photosensitive layer on an electroconductive substrate and rotates in the direction of the arrow. The developing sleeve 802 as a toner-carrying member comprising a non-magnetic cylinder rotates so as to move in the same direction as the electrostatic image-bearing member surface at the developing station. Inside the non-magnetic cylindrical sleeve 802 is disposed a multi-polar permanent magnet (magnet roll) so as not to rotate. The magnetic toner 810 in the developing device 807 is applied onto the non-magnetic cylinder 802 surface and the toner particles are provided with, e.g., a negative charge due to friction, e.g., between the developing sleeve 802 surface and the toner particles. The magnetic doctor blade 801 of iron is disposed in proximity with the cylindrical developing sleeve surface with a gap of about 50 microns to 500 microns and so as to confront one magnetic pole of the multi-polar permanent magnet, whereby a magnetic toner layer is formed in a thin and uniform thickness (30–300 microns) so that the magnetic toner layer is thinner than the gap between the electrostatic image-bearing member 809 and the developing sleeve 802 at the developing station. The revolution speed of the developing sleeve 802 is adjusted so that the sleeve surface velocity is substantially the same as or close to the speed of the electrostatic image-carrying surface. The image forming method and image forming apparatus according to the present invention are suitable for a high-speed development, so that the sleeve peripheral speed may preferably be set to 300 mm/sec or higher, particularly 400 mm/sec or higher. It is possible to compose the magnetic doctor blade 801 of a permanent magnet instead of iron. At the developing station, it is possible to apply an AC bias or a pulsed bias between the developing sleeve 802 and the electrostatic image-bearing member 809 surface by the biasing means 811. The AC bias may appropriately comprise a frequency f of 200–4,000 Hz and a peak-to-peak voltage Vpp of 500–3,000 V.

At the developing station, the toner particles are transferred to the electrostatic image side because of an electrostatic force exerted by the electrostatic image-bearing member surface and the action of the AC bias or pulsed bias electric field.

Instead of the magnetic doctor blade 801, an elastic blade formed of an elastic material such as silicone rubber can also be used to apply the toner in a regulated thickness onto the developing sleeve under the action of a pressing force.

In a case where the image forming apparatus according to the present invention is used as a printer for facsimile, the image light 805 may be replaced by exposure light image for printing received data.

The electric charge R of a toner layer on a developing sleeve described herein are based on values measured by the so-called suction-type Faraday cage method. More specifically, according to the Faraday cage method, an outer cylinder of a Faraday cage is pressed against the developing sleeve and the toner disposed on a prescribed area of the sleeve is sucked to be collected by the filter on the inner cylinder, whereby the toner layer weight in a unit area may be calculated from the weight increase of the filter. Simultaneously, the charge accumulated in the inner cylinder which is isolated from the exterior is measured to obtain the charge R on the sleeve.

The triboelectric charge Q (μc/g) of a magnetic toner may be measured in the following manner.

About 1 g of a sample magnetic toner and about 9 g of iron powder having iron powder carrier (200–300 mesh) are placed in an about 100 ml-polyethylene pot and are throughly mixed with each other by shaking in hands vertically about 60–80 reciprocations at a stroke of about 30 cm in about 30 seconds.

Figure 6:
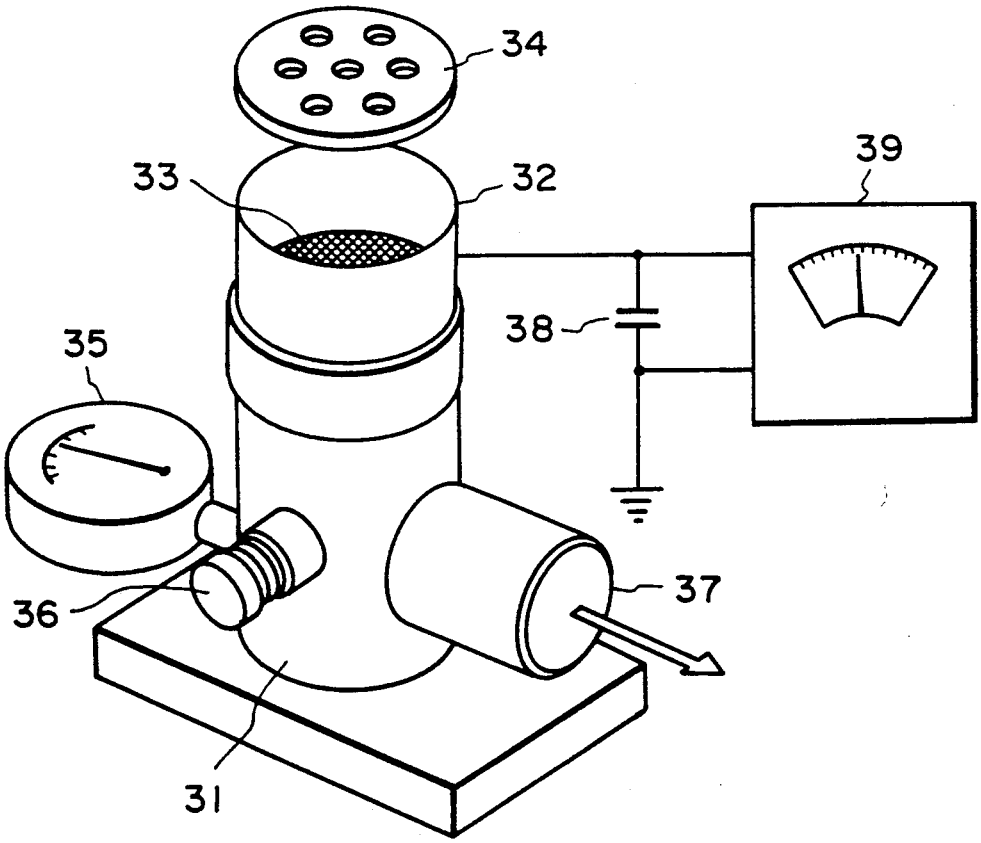
FIG. 6 is an illustration of an instrument for measuring triboelectric charge of a magnetic toner.

Then, about 1.0 g of the shaken mixture is charged in a metal container 32 for measurement provided with 400-mesh screen 33 at the bottom as shown in FIG. 6 and covered with a metal lid 34. The total weight of the container 32 is weighed and denoted by $W_1$ (g). Then, an aspirator 31 composed of an insulating material at least with respect to a part contacting the container 32 is operated, and the toner in the container is removed by suction through a suction port 37 sufficiently (about 1 min.) while controlling the pressure at a vacuum gauge 35 at 250 $mmH_2O$ by adjusting an aspiration control valve 36. The reading at this time of a potential meter 39 connected to the container by the medium of a capacitor having a capacitance C ($\mu$F) is denoted by V (volts.). The total weight of the container after the aspiration is measured and denoted by $W_2$ (g). Then, the triboelectric charge Q ($\mu$C/g) of the magnetic toner is calculated as: $CxV/(W_1-W_2)$.

The measurement is effected under the conditions of 23° C. and 60% RH. The iron powder carrier to be mixed with a sample toner is one having a size of 200–300 mesh as described above and is subjected in advance to a sufficient degree of suction by the above-mentioned asprinator to remove fine powder fraction passing through 400-mesh screen so as to avoid a measurement error.

Hereinbelow, the present invention will be described more specifically based on the following Examples, wherein "part(s)" for describing compositional ratios are all by weight.

EXAMPLE 1

Inside an electrophotographic copier NP-6550 (mfd. by Canon K.K.: electrostatic separation system, sleeve peripheral speed: 429 mm/sec) having basically and partially a structure shown in FIG. 5 and comprising an amorphous silicon drum, a cylindrical sleeve of stainless steel (SUS 304) containing a magnet therein was provided. The surface of the sleeve was provided with a plurality of sphere-traced concavities having a diameter R of 53–62 microns as shown in FIG. 9 formed by blasting with glass beads (substantially true sphere having a ratio of longer axis/shorter axis of almost 1.0) containing 80% by number or more of glass beads having a diameter of 53–62 microns from a blasting nozzle having a diameter of 7 mm disposed 100 mm spaced apart under the conditions of an air pressure of 4 kg/cm$^2$ and 2 min. The sleeve surface had an unevenness pattern with a pitch P of 33 microns and a surface roughness d of 2.0 microns. The thus treated sleeve was installed in the copier NP-6550.

On the other hand, a magnetic toner prepared in the following manner was used.

| | |
|---|---|
| Styrene/butyl acrylate/butyl maleate/divinylbenzene (copolymerization wt. ratio: 72.0/24.0/3.0/1.0; weight-average molecular weight (Mw): $35 \times 10^4$ | 100 parts |
| Magnetic iron oxide (average particle size (Dav.): 0.18 micron) | 100 parts |
| Monoazochromium complex | 1 part |
| Low-molecular weight ethylene/propylene copolymer | 4 parts |

The above ingredients were well blended in a blender and melt-kneaded at 150° C. by means of a two-axis kneading extruder. The kneaded product was cooled, coarsely crushed to 1 mm or smaller by a cutter mill, finely pulverized by means of a pulverizer using jet air stream at an air pressure of 6 kg/cm$^2$, and classified by a fixed-wall type wind-force classifier to obtain a classified powder product.

Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a magnetic toner A having a volume-average particle size of 6.6 microns.

The magnetic toner A showed a variation coefficient of number-basis particle size distribution of 28.1.

Table 1 appearing at the end hereof shows the particle size distribution measured by means of a Coulter counter Model TA-II with a 100 microns-aperture in the above-described manner and the triboelectric charge with iron powder also measured in the above-described manner of the magnetic toner A together with those of other magnetic toners obtained in other Examples and Comparative Examples appearing hereinafter.

0.7 part of hydrophobic dry process silica (BET specific surface area: 300 m$^2$/g) was added to 100 parts of the magnetic toner obtained above and mixed together by means of a Henschel mixer to obtain a magnetic toner A having the silica fine powder attached to the surface thereof.

The magnetic toner A was charged in the above-mentioned electrophotographic copier NP-6550 equipped with the sleeve having an uneven surface as shown in FIG. 9 to effect an image formation test, wherein a positively charged latent image formed on the amorphous silicon drum was developed under a sleeve peripheral speed of 429 mm/sec in a low temperature—low humidity environment of temperature of 15° C. and humidity of 10% RH. The image formation test was performed continuously for 5000 sheets of A4-size plain paper, and the results are shown in Table 2 also appearing at the end thereof.

As is clear from Table 2, the toner layer weight M/S per unit area on the sleeve showed an appropriate value of 1.15 mg/cm$^2$ at the initial stage and was stably retained at 1.21 mg/cm$^2$ even after the continuous image formation of 5000 sheets, and the toner coating on the sleeve was extremely uniform. The sleeve surface after the 5000 sheets of continuous operation was cleaned by air and observed through a scanning electron microscope whereby no attachment of toner component at the surface concavities was observed and substantially no soiling of the sleeve was observed. As a result, clear and high quality images having a high image density, free from fog and particularly excellent in resolution, thin-line reproducibility and gradation characteristic were formed at the initial stage as well as after the 5000 sheets of continuous image formation.

Similar good results were obtained as a result of a continuous operation test in a high temperature—high humidity environment of 32.5° C. and 85% RH.

EXAMPLE 2

A magnetic toner B having a particle size distribution shown in Table 1 was prepared by classifying the pulverized product in Example 1 under a controlled classification condition.

The magnetic toner was similarly mixed with the hydrophobic dry process silica fine powder and further with 2.0 parts of strontium titanate in a similar manner as in Example 1 to obtain a magnetic toner B in a modified state.

The magnetic toner B was subjected to the same evaluation as in Example 1. The results are shown in Table 2. Good images were obtained similarly as in Example 1.

EXAMPLE 3

| | |
|---|---|
| Crosslinked polyester resin ($Mw = 6 \times 10^4$) | 100 parts |
| Magnetic iron oxide (Dav.: 0.22 micron) | 100 parts |
| 3,5-Di-tert-butylsalicylic acid chromium complex | 2 parts |
| Low-molecular weight ethylene propylene copolymer | 3 parts |

A magnetic toner C having a different particle size distribution as shown in Table 1 was prepared from the above ingredients otherwise in a similar manner as in Example 1.

0.7 part of hydrophobic dry process silica (BET 300 $m^2/g$) was added to 100 parts of the magnetic toner C and mixed together by a Henschel mixer to obtain a modified magnetic toner C, which was then subjected to evaluation similarly as in Example 1 to obtain results shown in Table 2. As shown in Table 2, clear and high-quality images having a high image density, free from fog and thickening or cutting of thin lines were obtained at the initial stage as well as after the 5000 sheets of continuous operation. No soiling or toner coating irregularity on the sleeve was observed either.

EXAMPLE 4

| | |
|---|---|
| Styrene/butyl acrylate/butyl maleate/divinylbenzene (copolymerization wt. ratio: 72.0/24.0/3.0/1.0; ($Mw: 35 \times 10^4$) | 100 parts |
| Magnetic iron oxide (Dav.: 0.22 micron) | 100 parts |
| Monoazochromium complex | 0.5 part |
| Low-molecular weight ethylene/propylene copolymer | 3 parts |

A magnetic toner D having a particle size distribution as shown in Table 1 was prepared from the above ingredients through an additional intermediate pulverization step into about 50 microns prior to the fine pulverization step otherwise in a similar manner as in Example 1.

0.9 part of hydrophobic dry process silica fine powder (BET 200 $m^2/g$) was added to 100 parts of the magnetic toner D and mixed together in a Henschel mixer to obtain a modified magnetic toner D, which was evaluated in the same manner as in Example 1 to obtain results shown in Table 2. As is clear from Table 2, good images faithfully reproducing an original were obtained.

EXAMPLE 5

| | |
|---|---|
| Styrene/butyl acrylate/divinylbenzene copolymer ($75/24.5/0.5$; $Mw = 30 \times 10^4$) | 100 parts |
| Magnetic iron oxide (Dav.: 0.18 micron) | 100 parts |
| Monoazo chromium complex | 2 parts |
| Low-molecular weight ethylene/propylene copolymer | 3 parts |

A magnetic toner E having a particle size distribution shown in Table 1 was prepared from the above ingredients otherwise in a similar manner as in Example 1.

100 parts of the magnetic toner E was mixed with 0.8 part of hydrophobic dry process silica (BET 200 $m^2/g$) and 3.0 parts of strontium titanate by means of a Henschel mixer to obtain a modified magnetic toner E, which was then evaluated in a similar manner as in Example 1.

The results are shown in Table 2. Very high-quality images were obtained.

EXAMPLE 6

| | |
|---|---|
| Styrene/butyl acrylate/divinylbenzene copolymer ($75/24.5/0.5$; $Mw = 30 \times 10^4$) | 100 parts |
| Magnetic iron oxide (Dav.: 0.18 micron) | 100 parts |
| 3,5-Di-tert-butylsalicylic acid zinc complex | 2 parts |
| Low-molecular weight ethylene/propylene copolymer | 3 parts |

A magnetic toner F having a particle size distribution shown in Table 1 was prepared from the above ingredients otherwise in a similar manner as in Example 1.

100 parts of the magnetic toner F was mixed with 0.8 part of hydrophobic dry process silica (BET 200 $m^2/g$) by means of a Henschel mixer to obtain a modified magnetic toner F, which was then evaluated in a similar manner as in Example 1.

The results are shown in Table 2. Excellent images were obtained.

EXAMPLE 7

| | |
|---|---|
| Styrene/butyl acrylate/divinylbenzene copolymer ($75/24.5/0.5$; $Mw = 30 \times 10^4$) | 100 parts |
| Magnetic iron oxide (Dav.: 0.18 micron) | 100 parts |
| 3,5-Di-tert-butylsalicylic acid zinc complex | 2 parts |
| Low-molecular weight ethylene/propylene copolymer | 3 parts |

A magnetic toner G having a particle size distribution shown in Table 1 was prepared from the above ingredients otherwise in a similar manner as in Example 1.

100 parts of the magnetic toner G was mixed with 1.0 part of hydrophobic dry process silica (BET 300 $m^2/g$) by means of a Henschel mixer to obtain a modified magnetic toner E, which was then evaluated in a similar manner as in Example 1.

The results are shown in Table 2. High-quality images were obtained in a good state.

EXAMPLE 8

A magnetic toner H having a particle size distribution shown in Table 1 as prepared from the pulverized product in Example 7.

The magnetic toner H was modified and evaluated in a similar manner as in Example 1, whereby results shown in Table 2 were obtained.

EXAMPLE 9

A sleeve surface was treated in the same manner as in Example 1 except that #400 Carborundum particles as indefinite-shaped particles were used instead of the glass beads used in Example 1. The thus treated sleeve was used instead of the sleeve used in Example 1 and the toner A was evaluated otherwise in the same manner as in Example 1, whereby results shown in Table 2 were obtained.

Clear images free from fog were obtained at the initial stage but images obtained after the continuous image formation of 5000 sheets showed a slight decrease in image density.

The sleeve surface after the continuous operation was cleaned with air and observed through a scanning electron microscope, whereby some attachment of toner component was observed to show a slight degree of soiling of the sleeve.

EXAMPLE 10

A sleeve surface treated in the same manner as in Example 9 was further blasted for 1 minute with spherical glass beads containing 80% or more of beads having a diameter of 150–180 microns otherwise in the same manner as in Example 1. The thus treated sleeve was used instead of the sleeve used in Example 1 and the toner A was evaluated otherwise in the same manner as in Example 1, whereby results shown in Table 2 were obtained.

Good images almost similar to those in Example 1 were obtained.

EXAMPLE 11

In Example 1, a sleeve surface was not blasted with definite-shaped particles but finished into a smooth mirror-like surface by rubbing with cerium oxide fine powder as an abrasive. The thus treated sleeve was used instead of the sleeve used in Example 1 and the toner A was evaluated otherwise in the same manner as in Example 1, whereby results shown in Table 2 were obtained.

The resultant images showed a high density and were clear images free from fog but were somewhat inferior in respect of gradation characteristic in comparison with those obtained in Example 1.

COMPARATIVE EXAMPLE 1

A magnetic toner I having a volume-average particle size and a particle size distribution shown in Table 1 was prepared in a similar manner as in Example 1.

The magnetic toner I was modified with the hydrophobic dry process silica and then evaluated similarly as in Example 1, whereby results shown in Table 2 were obtained.

When the toner I was used, the resultant images showed a low image density and were accompanied with noticeable fog both at the initial stage and after the 5000 sheets of continuous image formation, thus being not satisfiable.

COMPARATIVE EXAMPLE 2

The coarsely crushed product in Example 3 was finely pulverized by a mechanical pulverizer using a rotor and a liner, followed by classification in a similar manner as in Example 1, to form a magnetic toner J having a particle size shown in Table 1.

The magnetic toner J was modified with silica similarly as in Example 3 and then evaluated similarly as in Example 1, whereby results shown in Table 2 were obtained.

Good images were obtained at the initial stage, but image defects were caused during the continuous image formation due to occurrence of toner coating irregularity on the sleeve.

COMPARATIVE EXAMPLE 3

| | |
|---|---|
| Styrene/butyl acrylate/butyl maleate/ copolymer divinyl benzene copolymer (72.0/24.0/3.0/1.0; Mw = $35 \times 10^4$) | 100 parts |
| Magnetic iron oxide (Dav.: 0.18 micron) | 100 parts |
| 3,5-Di-tert-butylsalicylic acid chromium complex | 3 parts |
| Low-molecular weight ethylene/ propylene copolymer | 3 parts |

A coarsely pulverized product prepared from the above ingredients otherwise in the same manner as in Example 1 was subjected to three times of repetitive fine pulverization by means of a fine pulverizer using jet air stream at an air pressure of 3 kg/cm$^2$, followed by classification in a similar manner as in Example 1 to obtain a magnetic toner K as shown in Table 1.

The magnetic toner K was modified with silica similarly as in Example 1 and then evaluated similarly as in Example 1, whereby results shown in Table 2 were obtained.

Good images were obtained at the initial stage, but image defects were caused during the continuous image formation due to occurrence of toner coating irregularity on the sleeve.

COMPARATIVE EXAMPLE 4

| | |
|---|---|
| Styrene/butyl acrylate/divinylbenzene copolymer (75/24.5/0.5; Mw = $30 \times 10^4$) | 100 parts |
| Magnetic iron oxide (Dav.: 0.18 micron) | 100 parts |
| 3,5-Di-tert-butylsalicylic acid zinc complex | 1 part |
| Low-molecular weight ethylene/ propylene copolymer | 3 parts |

A magnetic toner L having a particle size distribution shown in Table 1 was prepared from the above ingredients otherwise in a similar manner as in Example 1.

The magnetic toner U was modified with silica similarly as in Example 1 and then evaluated similarly as in Example 1, whereby results shown in Table 2 were obtained.

The resultant images showed a low image density and some fog but showed excellent resolution and thin-line reproducibility.

Figure 7:
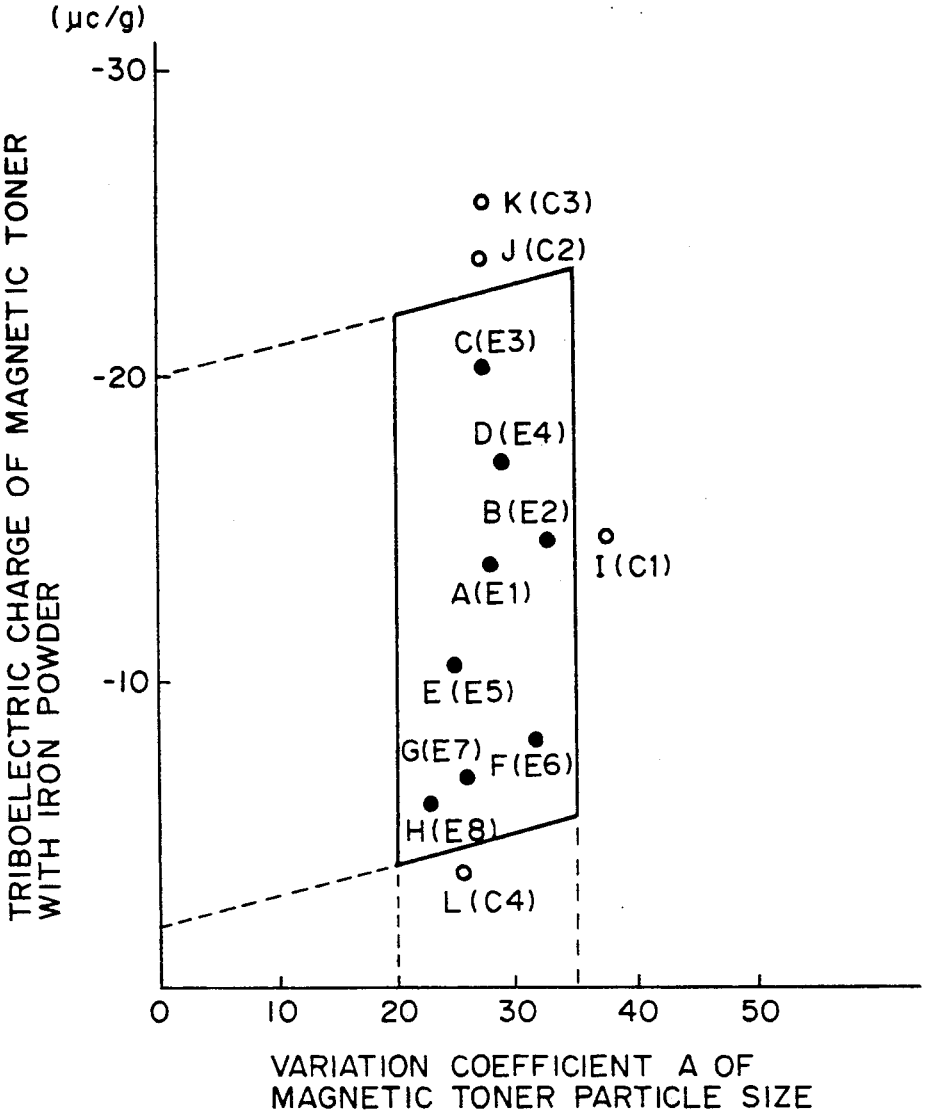
FIG. 7 is a graph showing plotted values of variation coefficient A of number-basis particle size distribution and triboelectric charge ($\mu c/g$) of magnetic toners according to Examples and Comparative Examples.

FIG. 7 shows the plots of the variation coefficients A of number-basis particle size distribution and triboelectric charges Q of the above-prepared magnetic toners A–L. In FIG. 7, E1 and C1, for example, in the parentheses represent Example 1 and Comparative Example 1, respectively.

TABLE 1

| | Toner | (Toner properties) Particle size distribution: Average size (μm) volume-basis | number-basis | Standard deviation S | Variation coefficient A | Triboelectric charge Q (μc/g) |
|---|---|---|---|---|---|---|
| Invention | A | 6.57 | 5.49 | 1.54 | 28.1 | −13.8 |
| | B | 6.53 | 5.20 | 1.70 | 32.7 | −14.6 |
| | C | 5.47 | 4.57 | 1.25 | 27.4 | −20.3 |
| | D | 5.33 | 4.35 | 1.16 | 29.0 | −17.2 |
| | E | 5.37 | 4.63 | 1.26 | 25.0 | −10.5 |
| | F | 6.47 | 5.21 | 1.65 | 31.7 | −8.1 |
| | G | 4.49 | 3.78 | 0.98 | 25.8 | −7.9 |
| | H | 4.39 | 3.91 | 0.90 | 23.0 | −7.0 |
| Comparative | I | 6.21 | 4.89 | 1.84 | 37.6 | −14.7 |
| | J | 5.35 | 4.51 | 1.23 | 27.2 | −23.9 |
| | K | 5.40 | 4.43 | 1.21 | 27.3 | −25.8 |
| | L | 6.07 | 5.16 | 1.37 | 26.6 | −3.8 |

TABLE 2

| | Toner | Initial Density | Initial M/S mg/cm² | 500 sheets Density | 500 sheets M/S mg/cm² | Coating characteristic (1) | Transferability (2) | Soiling of sleeve (3) | Gradation (4) | Charge on sleeve R (μc/g) |
|---|---|---|---|---|---|---|---|---|---|---|
| Ex. 1 | A | 1.35 | 1.15 | 1.37 | 1.21 | o | o | o | ◎ | −10--15 |
| 2 | B | 1.36 | 1.23 | 1.39 | 1.25 | o | o | o | ◎ | −11--17 |
| 3 | C | 1.33 | 1.19 | 1.42 | 1.51 | o | o | o | ◎ | −13--20 |
| 4 | D | 1.40 | 1.42 | 1.40 | 1.39 | o | o | o | ◎ | −12--18 |
| 5 | E | 1.30 | 1.20 | 1.33 | 1.22 | o | o | o | ◎ | −9--12 |
| 6 | F | 1.30 | 1.07 | 1.30 | 1.13 | o | o | o | ◎ | −7--13 |
| 7 | G | 1.34 | 1.08 | 1.35 | 1.16 | o | o | o | ◎ | −7--12 |
| 8 | H | 1.37 | 1.31 | 1.38 | 1.25 | o | o | o | ◎ | −8--14 |
| 9 | A | 1.34 | 1.17 | 1.30 | 1.04 | o | o | x | o | −8--12 |
| 10 | A | 1.38 | 1.27 | 1.40 | 1.30 | o | o | o | ◎ | −10--14 |
| 11 | A | 1.36 | 1.49 | 1.42 | 1.65 | Δ | o | o | Δ | −12--15 |
| Comp. Ex. 1 | I | 1.15 | 1.20 | 1.05 | 0.97 | o | o | o | o | −10--15 |
| 2 | J | 1.42 | 1.59 | — | — | x | x | o | ◎ | −17--26 |
| 3 | K | 1.40 | 1.55 | — | — | x | x | o | ◎ | −19--28 |
| 4 | L | 0.91 | 0.87 | 1.01 | 0.96 | o | x | o | Δ | −3--5 |

The standards for evaluation in Table 2 were as follows:

(1) Coating characteristic
- o: Irregularity not observed on sleeve.
- Δ: Irregularity observed on sleeve but not on the images.
- x: Irregularity both on sleeve and images.

(2) Transferability
- o: Good
- x: Back transfer or retransfer to the latent image-bearing member occurred.

(3) Soling of sleeve
- o: Not observed
- x: occurred.

(4) Gradation (Reproducibility of gradational image)
- ◎: Excellent
- o: Good
- Δ:Acceptable
- x: Not acceptable As described above, according to the image forming method and image forming apparatus of the present invention using a magnetic toner showing specific particle size distribution and triboelectric chargeability, the following advantageous effects are exhibited.

(1) Uniform coating of the magnetic toner is accomplished on various types of developing sleeves even under a low-humidity condition.

(2) A uniform coating layer of the magnetic toner can be formed even on a sleeve rotating at a high peripheral speed.

(3) Clear images having a high image density, excellent in thin line reproducibility, resolution and gradation characteristic and also free from fog can be provided for a long period of time.

What is claimed is:

1. An image forming method, comprising the steps of:

disposing a latent image-bearing member and a toner-carrying member with a prescribed gap therebetween, said toner-carrying member comprising a cylindrical sleeve;

supplying a magnetic toner onto the cylindrical sleeve, wherein the magnetic toner comprises a binder resin and magnetic powder and is in the form of particles providing a volume-average particle size between 4 microns and 7 microns and having a number-basis distribution and a triboelectric chargeability satisfying the relation of:

$$-0.1(\mu c/g)\times A-20(\mu c/g)\leqq Q(\mu c/g)\leqq -0.1(\mu c/g)\times A-2(\mu c/g),$$

wherein A is a real number in the range of 20–35 denoting a coefficient of variation of a number-basis distribution of particle sizes of the magnetic toner defined by $(S/\overline{D}_1)\times 100$ wherein S denotes a standard deviation of the number-basis distribution of particle sizes of the magnetic toner and $\overline{D}_1$ denotes a number-average particle size of the magnetic toner, and Q denotes a triboelectric charge ($\mu c/g$) of the magnetic toner with iron powder;

triboelectrically charging the magnetic toner to provide the magnetic toner with a negative charge;

forming an electrostatic latent image on the latent image-bearing member;

developing the electrostatic latent image with the magnetic toner having a negative triboelectric charge, on the cylindrical sleeve while the cylindrical sleeve is rotated at a peripheral speed of at least 220 mm/sec., thereby forming a toner image; and transferring the toner image on the latent image-bearing member to a transfer-receiving material.

2. The image forming method according to claim 1, wherein the toner-carrying member comprises a cylindrical sleeve enclosing a magnet therein.

3. The image forming method according to claim 2, wherein the cylindrical sleeve has an uneven surface formed by blasting with definite-shaped particles.

4. The image forming method according to claim 3, wherein the definite-shaped particles comprises spherical particles having a diameter of 20–250 microns.

5. The image forming method according to claim 2, wherein the cylindrical sleeve is rotated at a peripheral speed of 300 mm/sec or higher.

6. The image forming method according to claim 2, wherein the cylindrical sleeve is rotated at a peripheral speed of 400 mm/sec or higher.

7. The image forming method according to claim 1, wherein the toner-carrying member comprises a cylindrical sleeve enclosing a magnet therein, has an uneven surface formed by blasting with definite-shaped particles comprising spherical particles having a diameter of 20–250 microns as a major component, and is rotated at a peripheral speed of 400 mm/sec or higher.

8. The image forming method according to claim 1, wherein the magnetic toner comprises 50–150 wt. parts of the magnetic powder per 100 wt. parts of the binder resin.

9. The image forming method according to claim 1, wherein the magnetic toner comprises 60–120 wt. parts of the magnetic powder per 100 wt. parts of the binder resin.

10. The image forming method according to claim 1, wherein the magnetic toner further comprises hydrophobic silica fine powder.

11. The image forming method according to claim 1, wherein the magnetic toner has a coefficient of variation of number-basis particle size distribution in the range of 21–34.

12. The image forming method according to claim 1, wherein the magnetic toner has a triboelectric chargeability satisfying the relationship of:

$$-0.1A-19 \leqq Q \leqq -0.1A-3.$$

13. The image forming method according to claim 1, wherein the magnetic toner has a triboelectric chargeability satisfying the relationship of:

$$-0.1A-18 \leqq Q \leqq -0.1A-4.$$

14. The image forming method according to claim 1, wherein the magnetic toner has a triboelectric charge R on the toner-carrying member, the triboelectric charge R differing from the triboelectric charge Q by 0–15 $\mu c/g$ in terms of an absolute value.

15. The image forming method according to claim 1, wherein the cylindrical sleeve has an uneven surface showing a surface roughness d of 0.1–5 microns and an unevenness pitch of 2–100 microns.

16. The image forming method according to claim 1, wherein the toner image on the latent image-bearing member is electrostatically transferred to the transfer-receiving material, and then the transfer-receiving member carrying the toner image is separated from the latent image-bearing member by an electrostatic means.

17. The image forming method according to claim 1, wherein the toner-carrying member is disposed with a gap of 50–500 microns from the latent image-bearing member, the magnetic toner is disposed on the toner-carrying member in a layer with a thickness of 30–300 microns which is smaller than the gap, and a bias voltage is applied to the toner-carrying member.

18. The image forming method according to claim 17, wherein the toner-carrying member is supplied with an AC bias having a frequency of 200–4000 Hz and a peak-to-peak voltage of 500–3000 V and a DC bias.

19. The image forming method according to claim 1, wherein the magnetic toner has a volume-average particle size of 4 to 6.6 microns.

* * * * *

UNITED STATES PATENT AND TRADEMARK OFFICE

CERTIFICATE OF CORRECTION

PATENT NO. : 5,310,615

DATED : May 10, 1994

INVENTOR(S) : TANIKAWA

It is certified that error appears in the above-indentified patent and that said Letters Patent is hereby corrected as shown below:

On the title page, item [56] References Cited

U.S. PATENT DOCUMENTS:

Change "Nakuhara et al." to --Nakahara et al.--.

FOREIGN PATENT DOCUMENTS:

Change "0331425 9/1989 European Pat. Off." (second occurrence) to
--0331426 9/1989 European Pat. Off.--.

Column 1

Line 55, change "ep-" to --rep- --.

Column 2

Line 50, change "the" to --tone toner coating layer--.

Column 5

Line 26, change "members" to --members,--.

Column 6

Line 61, delete "by".

UNITED STATES PATENT AND TRADEMARK OFFICE

CERTIFICATE OF CORRECTION

PATENT NO. : 5,310,615

DATED : May 10, 1994

INVENTOR(S) : TANIKAWA

It is certified that error appears in the above-indentified patent and that said Letters Patent is hereby corrected as shown below:

Column 8

Line 27, change "toner. When" to --toner, when--.

Column 10

Line 4, change "Form" to --From--.

Column 12

Line 56, change "compared" to --compared to--.

Column 14

Line 4, change propylaminopropyltrtimethoxysilane," to --propylaminopropyltrimethoxysilane,--.

Column 17

Line 30, change "asprinator" to --aspirator--.

Column 23

Line 53, change "Soling" to --Soiling--.

UNITED STATES PATENT AND TRADEMARK OFFICE

CERTIFICATE OF CORRECTION

PATENT NO. : 5,310,615

DATED : May 10, 1994

INVENTOR(S) : TANIKAWA

It is certified that error appears in the above-indentified patent and that said Letters Patent is hereby corrected as shown below:

Column 24

Line 55, change "between 4 microns and" to --of greater than or equal to 4 microns, but less than--; and Line 65, change "$(S/\bar{D}_1)$ x 100" to --$(S/\bar{D}_1)$ x 100,--.

Column 25

Line 23, change "comprises" to --comprise--.

Signed and Sealed this

Sixth Day of December, 1994

Bruce Lehman

*Attest:*

BRUCE LEHMAN

*Attesting Officer*

*Commissioner of Patents and Trademarks*